United States Patent [19]

Holley

[11] 3,987,495

[45] Oct. 26, 1976

[54] MOTORCYCLE HELMET

[75] Inventor: James D. Holley, Crowley, La.

[73] Assignee: The Raymond Lee Organization, Inc., a part interest

[22] Filed: Aug. 11, 1975

[21] Appl. No.: 603,311

[52] U.S. Cl. ..... 2/410

[51] Int. Cl.[2] ..... A42B 3/00

[58] Field of Search ..... 2/3 R, 3 A, 3 B, 3 C, 2/6

[56] References Cited

UNITED STATES PATENTS

| | | | |
|---|---|---|---|
| 2,855,604 | 10/1958 | Austin | 2/171.1 X |
| 3,324,255 | 6/1967 | Romba | 2/6 X |
| 3,353,188 | 11/1967 | Crincic | 2/171.1 |
| 3,514,787 | 6/1970 | Kennedy | 2/3 R |
| 3,579,637 | 5/1971 | Aileo | 2/3 R |

FOREIGN PATENTS OR APPLICATIONS

| | | | |
|---|---|---|---|
| 1,053,195 | 3/1959 | Germany | 2/3 R |

*Primary Examiner*—Alfred R. Guest

[57] ABSTRACT

A motorcycle helmet has two halves which may be detachably secured together for use or separated for easy storage in one or more of the saddlebags of a motorcycle. The two halves come together at the central vertical plane that extends from the front of the helmet to the rear and thereby divides it into a right half and a left half that are mirror images of each other.

3 Claims, 10 Drawing Figures

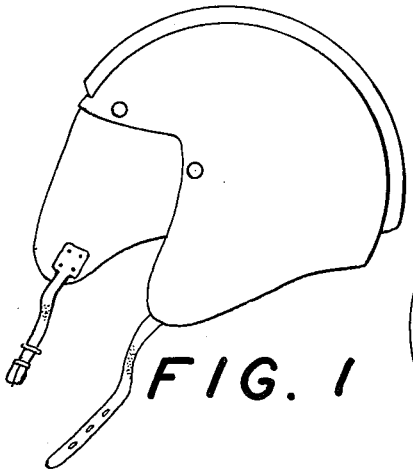
FIG. 1
FIG. 4
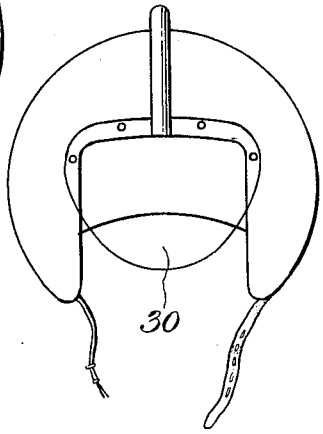
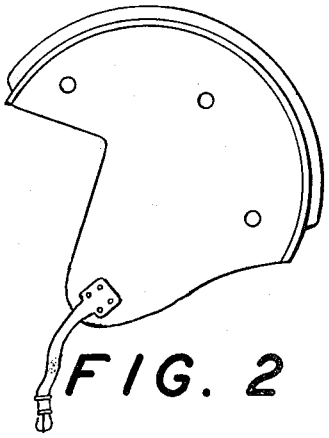
FIG. 2
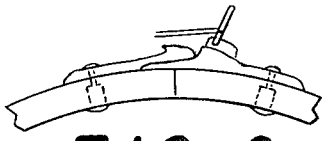
FIG. 9
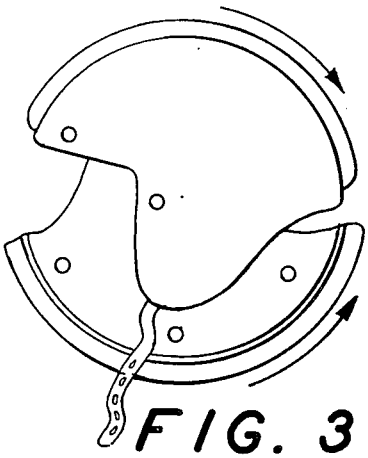
FIG. 3
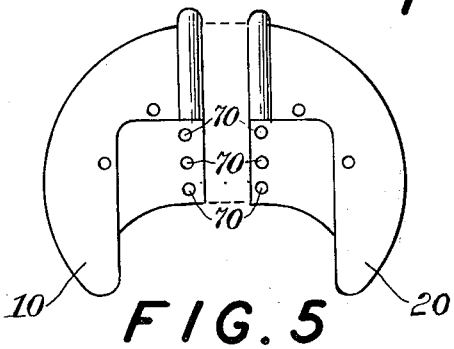
FIG. 5
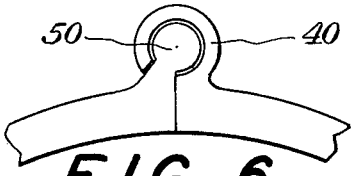
FIG. 6
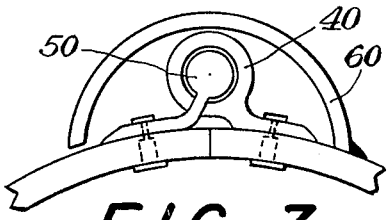
FIG. 7
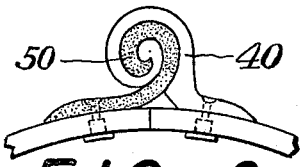
FIG. 8
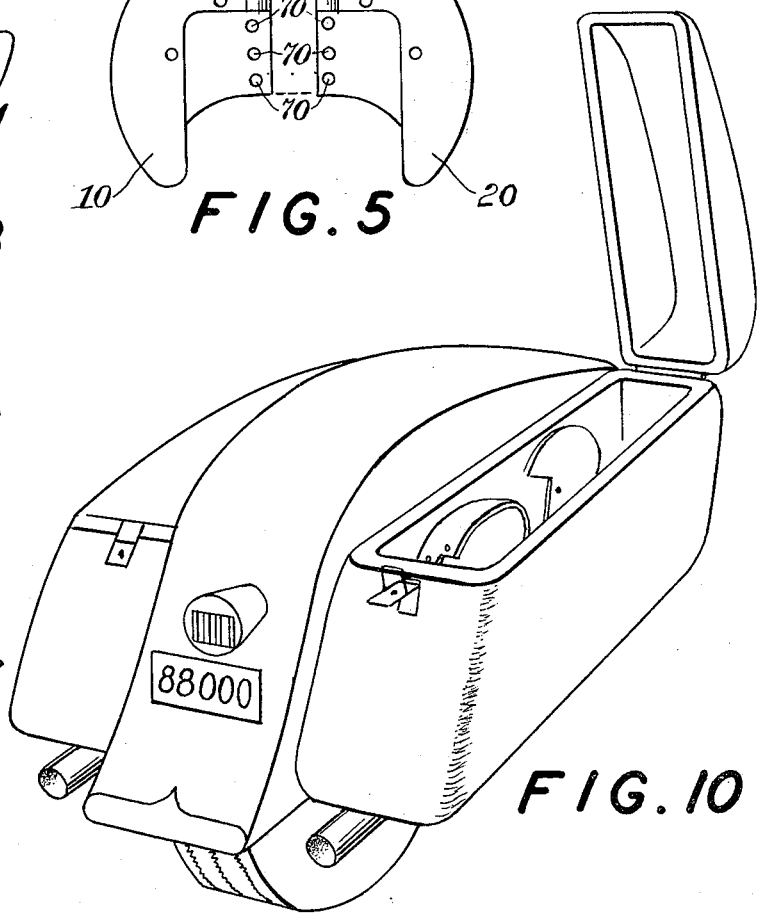
FIG. 10

MOTORCYCLE HELMET

SUMMARY OF THE INVENTION

This invention is an improved helmet for motorcyclists and the like. Conventional helmets are made of a one-piece construction that renders the helmet too bulky for storage in a conventional motorcycle saddlebag.

In this invention, the helmet is made with a two-piece construction that allows the helmet to be separated into a right half and a left half that are mirror images of each other. When the helmet is to be used, it is assembled together. When the helmet is to be stored in a motorcycle saddlebag, it can be disassembled.

BRIEF DESCRIPTION OF THE DRAWINGS

FIG. 1 shows a drawing of the invention.

FIG. 2 shows a side view of the invention.

FIG. 3 shows one embodiment of the invention being assembled.

FIG. 4 shows a front view of the invention.

FIG. 5 shows the invention in a disassembled state.

FIGS. 6, 7, 8 and 9 show four embodiments of a portion of the invention.

FIG. 10 shows the invention disassembled for storage in a motorcycle saddlebag.

DETAILED DESCRIPTION OF THE PREFERRED EMBODIMENT

A helmet right half 10 and left half 20 are mirror images of each other, and when they are assembled together, they take on the shape of a conventional motorcycle helmet. Individually they take the form of the right and left halves of a conventional motorcycle helmet that has been bisected along the central vertical plane that extends from the front of the helmet to the rear. The halves may have provisions for the attachment of face shields 30 or the like. At all events, means such as those shown in FIGS. 6, 7, 8 and 9 may be used to detachably secure the halves together. In these embodiments, corresponding portions of different embodiments will be identified by the same identification number.

In the devices shown in FIGS. 6, 7, and 8, a grooved track 40 cooperates with a rail 50 to hold the halves together. The track is attached to one of the halves, and extends around its top surface along its central edge; that is, the edge that will abut the other half. The rail is similarly mounted. The only difference between the structure of the rail and track between FIGS. 6 and 7 is that in the former, the elements are integrally molded with their corresponding halves and are riveted to their corresponding halves in the latter one. In all three figures, however, the track has a large central groove connected to the outside by a smaller slot. The rail is introduced into the track by the rotational motion shown in FIG. 3, to lock the halves together. In FIG. 8 the rail has a spiral structure and engages with a corresponding spiral groove in the track. The curved shield 60 is attached to one half and arches over the track and rail to improve the appearance of the device when assembled and to eliminate dust and dirt from the groove in the track. This shield may be used with any or all devices shown.

In FIG. 9, a conventional buckle is shown; it is one of a plurality of like buckles that hold the halves together. The snap connectors 70 that are located at the rear of each section in FIG. 5 are used to prevent the halves from rotating with respect to one another while they are assembled. A locking pin may also be used for this purpose, if desired.

I claim:

1. A helmet for motorcycle and the like comprising:

a rigid left half that takes the form of the left half of a conventional helmet that has been bisected along a central vertical plane running from the front of the helmet to the rear;

a rigid right half taking the form of a mirror-image of the left half;

a curved grooved track attached to one of the halves; and a curved rail attached to the other half, the rail engaging the groove in the track to secure the two halves together.

2. The device of claim 1 wherein the groove defines a spiral.

3. The device of claim 2 wherein the rail has a spiral structure engaging the spiral groove.

* * * * *